United States Patent [19]

Collins et al.

[11] 4,271,777

[45] Jun. 9, 1981

[54] APPARATUS FOR REFORMING ROUND CANS INTO RECTANGULAR CANS

[75] Inventors: Floyd A. Collins; Joseph L. Spychalski, both of Geneva, N.Y.

[73] Assignee: American Can Company, Greenwich, Conn.

[21] Appl. No.: 36,451

[22] Filed: May 7, 1979

[51] Int. Cl.[3] ..... B21D 5/08

[52] U.S. Cl. ..... 113/1 G; 72/176; 113/120 M

[58] Field of Search ..... 113/1 G, 120 M; 72/176, 72/181, 234, 235

[56] References Cited

U.S. PATENT DOCUMENTS

| | | | |
|---|---|---|---|
| 3,056,447 | 10/1962 | Powell | 113/120 M X |
| 3,736,846 | 6/1973 | Frankenberg | 113/120 M X |

*Primary Examiner*—Howard N. Goldberg

*Attorney, Agent, or Firm*—Robert P. Auber; George P. Ziehmer; Stuart S. Bowie

[57] ABSTRACT

Apparatus for reforming round cans into rectangular cans including an anvil having an entrance and an exit end, a gripper chain for moving the cans along the anvil; side-mounted rollers or belts for forming the round can into a rectilinear shape; and a paneling roller for creasing the can into a rectilinear shape prior to the exit end of the anvil.

3 Claims, 10 Drawing Figures

APPARATUS FOR REFORMING ROUND CANS INTO RECTANGULAR CANS

BACKGROUND OF THE INVENTION

There are various techniques in the prior art for reforming round cans into a rectilinear shape. These prior art patents include the following: U.S. Pat. Nos. 1,966,349; 2,073,174; 2,429,169; 2,895,527; 2,926,774; 3,056,447; 3,271,984; and 3,736,846.

U.S. Pat. No. 3,736,846 relates to a device for reshaping cemented containers which are supplied in an end-to-end relationship directly from a body maker. The apparatus employs corner posts which extend from a transitional entrance mandrel. Reforming shoes and rotatable reforming rolls are employed to provide the external force for reshaping. Side walls of the cans are over-distended to compensate for spring-back.

U.S. Pat. No. 3,056,447 reforms round cans by conveying cans with a grip chain over a framework of bars in cooperation with external guide bars. A pair of driven paneling rolls in combination with an anvil introduce permanent panels in the side walls.

U.S. Pat. No. 1,966,349 employs a floating mandrel on a machine for reforming flatened cans into round cans and a series of support links are mounted on the conveyor chains which travel beneath the mandrel. The support links engage a slot on the underside of the mandrel and the mandrel is thus made to "float" on a series of moveable conveyor links.

Of somewhat less relevance in U.S. Pat. No. 2,073,174 in which there is shown a device for reforming metal tape using mated reforming rolls.

SUMMARY OF THE PRESENT DISCLOSURE

The present disclosure relates to an apparatus for reforming pre-coated cylindrical cans into rectangular cans. The apparatus which is designed to be attached to the discharge end of a body maker is aligned with the body maker so that the cylindrical can body is conveyed from the mandrel of the body maker directly onto the anvil or the mandrel of the reformer. The side seam of the can, which is maintained in a six o'clock position throughout the reforming, is preferably striped with lacquer inside and out just prior to reforming.

The reforming apparatus of the present invention consists of a "floating" anvil which rides on a revolving support roll. The anvil cross section varies from a "dog bone" shape at the input end to a larger "dog-bone" shape at the exit end. A series of reforming rolls or belts are positioned longitudinally along either side of the anvil and cooperate with the anvil in exerting reforming pressure on the can wall.

Both the reforming and support rolls are driven with a rim speed equal to the conveyor speed so that the friction between the can wall and rolls is minimized, thereby lessening the chance of damaging the finish. A final set of reforming or paneling rolls, which operate against free wheeling interior rolls, are profiled to impart a slight crease in the side panels. The creases oppose the natural spring-back tendency of the side walls, thereby enabling the can to retain a rectangular shape. The reforming rolls are pivotably mounted thereby permitting the extent of creasing to be adjusted. In an alternative embodiment, instead of side rolls, there is provided a pair of opposed belts which act against the can to force the same against the anvil to assist in reforming the can shape from round to rectangular.

DETAILED DESCRIPTION OF THE PREFERRED EMBODIMENT

This invention relates to a method and apparatus for the reforming of round can bodies into rectangular can bodies at high speed.

Thus, the receiving end 11 of the reforming apparatus 100 receives a round can 12 on a forming anvil or rail 13 at the entrance end **13*d* thereof. The cans 12** preferably are delivered directly from a conventional roll form body maker (not shown) so as to present the can with the side seam in a six o'clock position.

Figure 5:
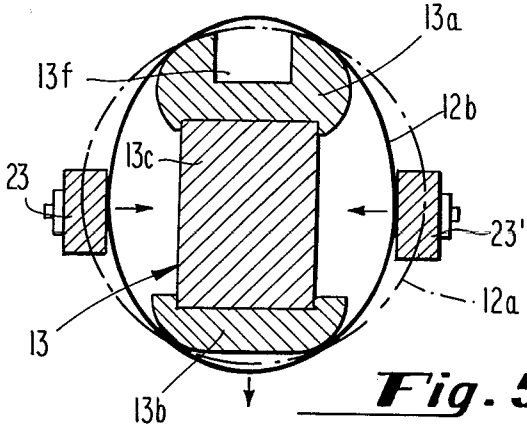
FIG. 5 is a cross section of the reforming anvil taken along the lines 5—5 of FIG. 4.

The cans 12 are engaged by a gripper chain 14 which pushes them through the apparatus 100 over anvil 13. Anvil 13 has a top portion **13*a* and bottom portion 13*b* spaced apart by spacer blocks 13*c*. Bottom portion 13*b* extends downwardly from the receiving end 11 to a point near paneling rollers 114,114' thereby increasing the height of the "dog bone" shaped anvil 13 as the cans move through the apparatus 100 so as to stretch the cans into rectangular shape (See FIGS. 7 and 5). As the cans reach the paneling rollers 114,114' the top 13*a* and bottom 13*b* of the anvil are equal to the desired widest dimension of the rectangular can body (FIG. 8**).

In the embodiment shown in FIGS. 1–8, there are a series of opposed horizontal rollers **15*a–h*, 15*a'–h'*, on each side of the forming anvil 13, each of which is mounted for rotation on a frame member 17 as will be described. The member 17 is pivotably adjustable at 17*a* and angled (FIG. 2) so that the rollers 15 are increasingly closer to the side of the can 12 (and the anvil 13) as the can 12 approaches the paneling rollers 114,114'. There is also a guide bar, 23' on either side of anvil 13 proximate the entrance end which assists in pressing in the can sides from its original shape 12*a* to an oblong shape 12*b* (FIG. 5) as the can presses between the rollers 15**.

Figure 8:
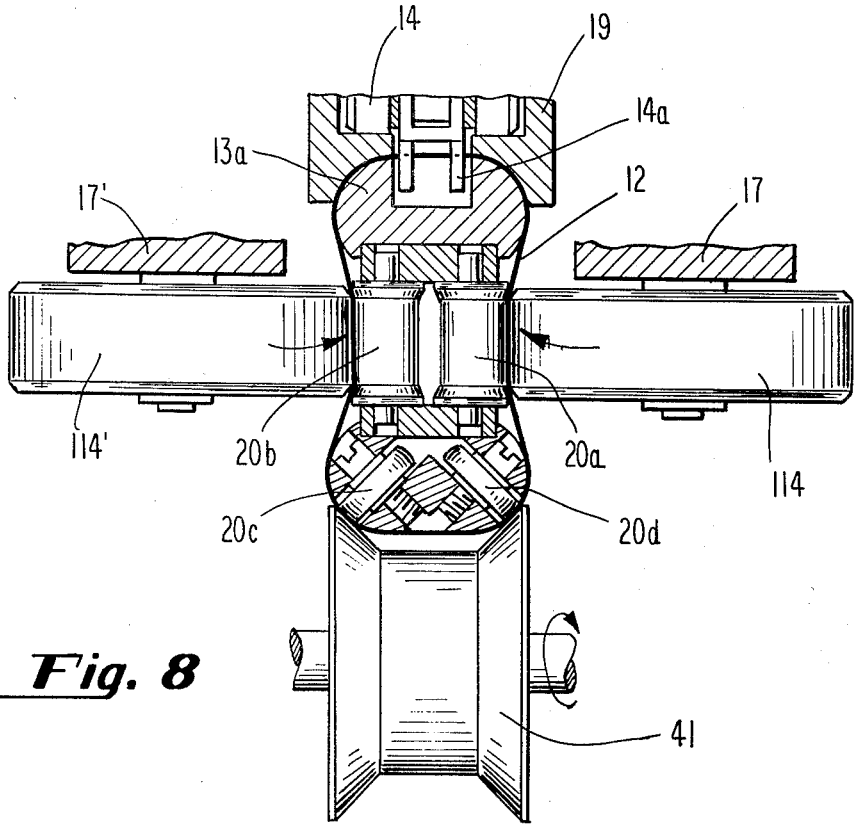
FIG. 8 is a view, partly in section taken along the lines 8—8 of FIG. 1.

The paneling rollers 114,114' also carried by member 17, actually permanently reform the can 12 into the desired rectangular shape by imparting permanent creases in the can as shown in FIG. 8. The rollers 114,114' cooperate with interior rollers **20*a*, 20*b*, 20*c*, 20*d* within the anvil 13 as shown in FIG. 8**.

It should be noted that the anvil 13 is of the "floating" type, that is supported at its free end by driven support roll 41 which, like rolls 15, moves at the same rim speed as cans 12 to avoid scuffing.

Anvil upper member 13*a* has a slot 13*f* through which Fingers 14*a* of gripper chain 14 passes.

Chain 14 is moved about sprockets 30,31. In turn, sprocket 30 is turned by another sprocket 32 through suitable gearing. Sprocket 32 is rotated by a chain 33 driven by a sprocket 34 driven through gearing by a revolving shaft 35 of a power source (not shown).

Through a series of sprockets 36, 37 and 38, chain 33 also drives a sprocket 39 adjacent the exit end of the machine. Sprocket 39, in turn, drives a chain 40 which drives wheel 41 located beneath panelling rollers 114,114'.

Chain 14 also drives a sprocket 50 and a bevel gear 51 coupled thereto. Gear 51, in turn, drives bevel gear 52 and the latter rotates a gear 60. In turn, gear 60 drives gear 61, which is affixed to roller 15*a* through a shaft and thus operates to turn roller 15*a* at the same linear speed as the can 12 pushed by gripper chain 14.

Figure 7:
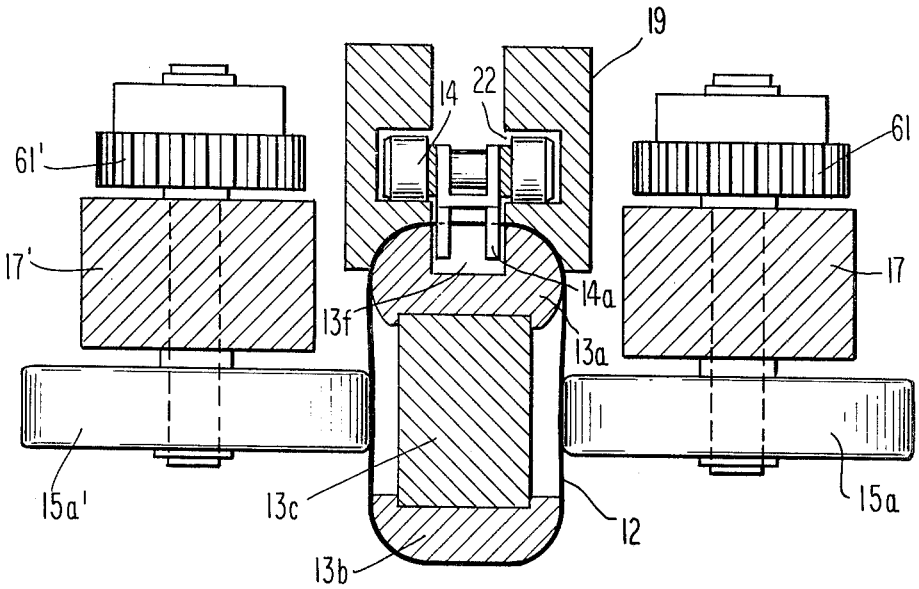
FIG. 7 is a view, partly in section, taken along the lines 7—7 of FIG. 1.

Gear 60 also rotates gears 62–77, every odd one of which is affixed to the shaft of the rollers 15*b*–15*h* and panelling roller 14, whereby all of the rollers 14 and 15 are rotated at the same linear speed as the chain 14 and thus the can 12, thereby avoiding marring the can surface a corresponding set of gears is disposed on the other side of anvil 13 to drive rollers 15*a'*–15'. FIG. 7 shows spur gears 61,61' mounted to drive paneling rollers 15*a*,15*a'* at the same linear speed as drive chain 14 and can 12.

Figure 1:
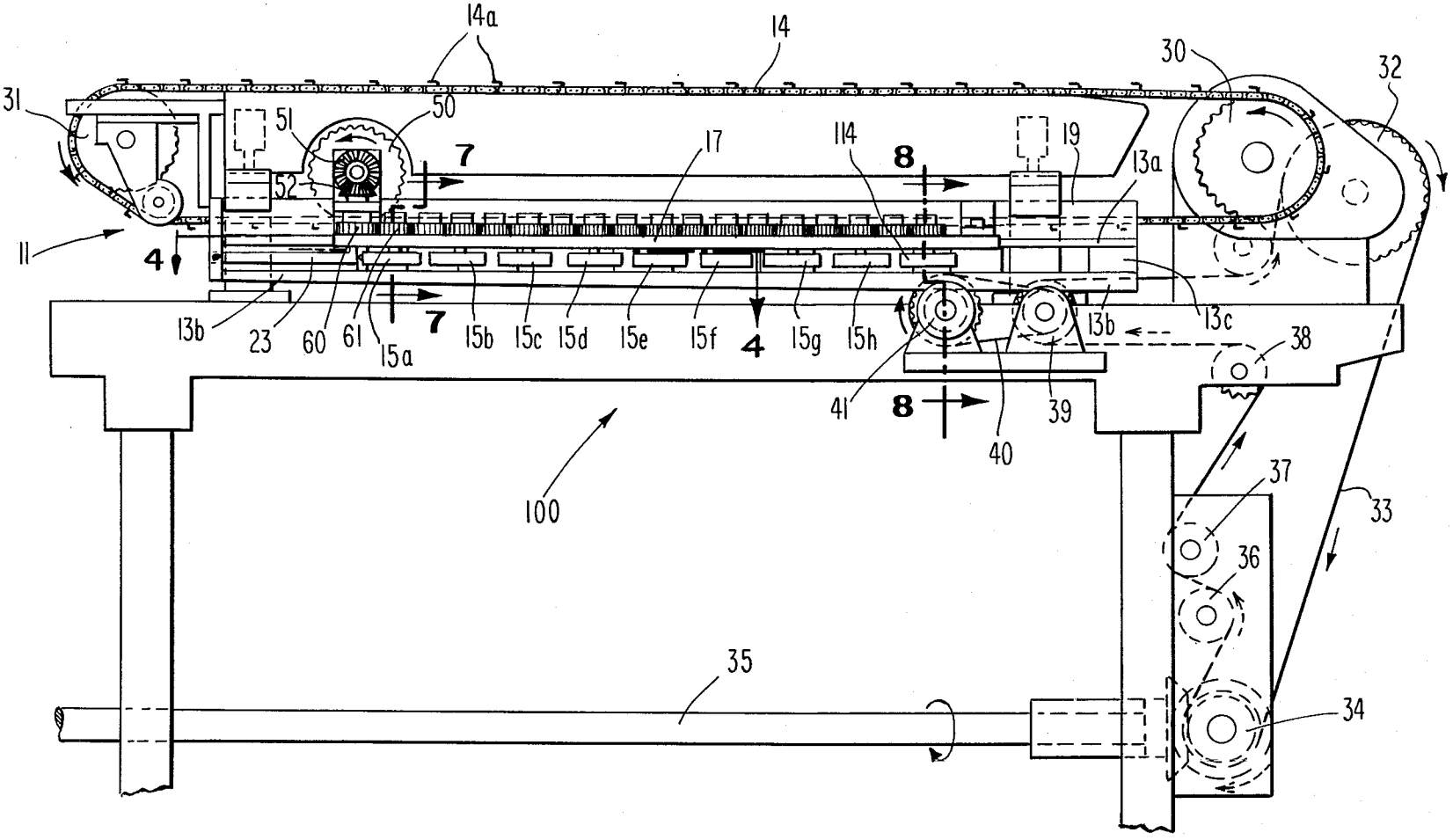
FIG. 1 is a side elevation of the reforming apparatus.
Figure 2:
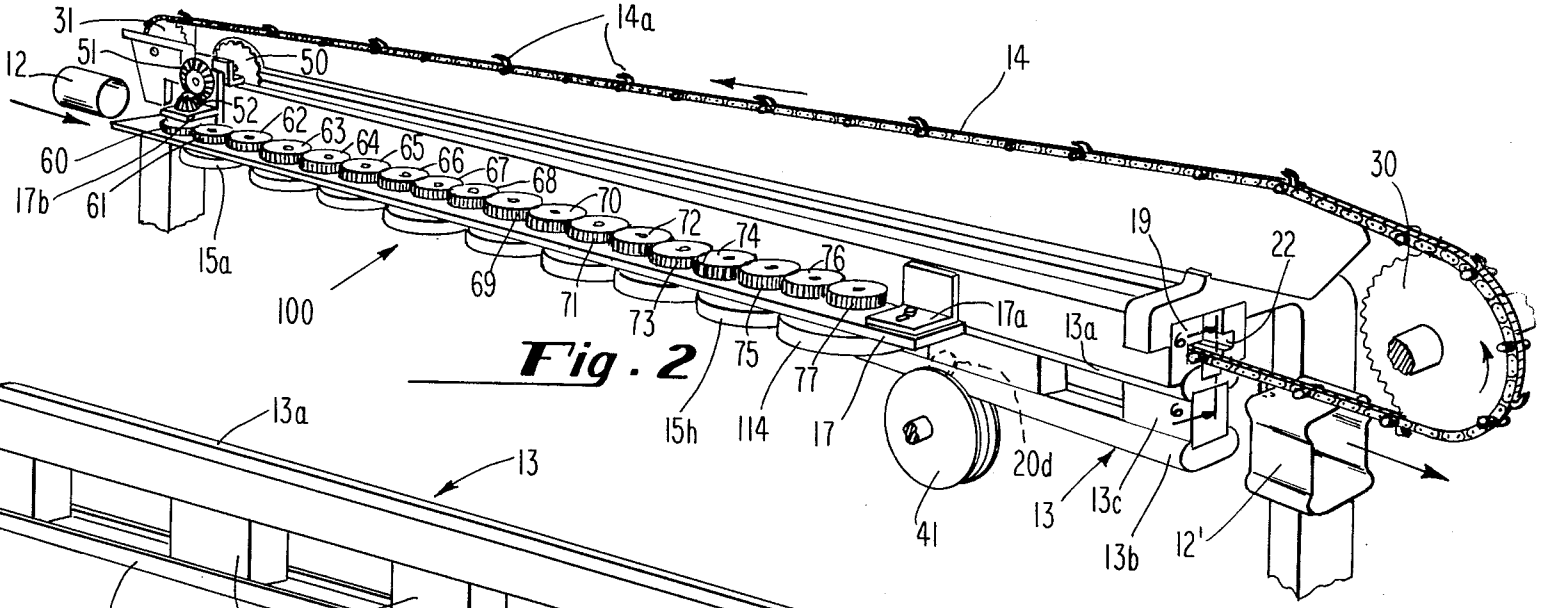
FIG. 2 is a perspective view of the reforming apparatus shown in FIG. 1 with some parts removed to show detail.
Figure 3:
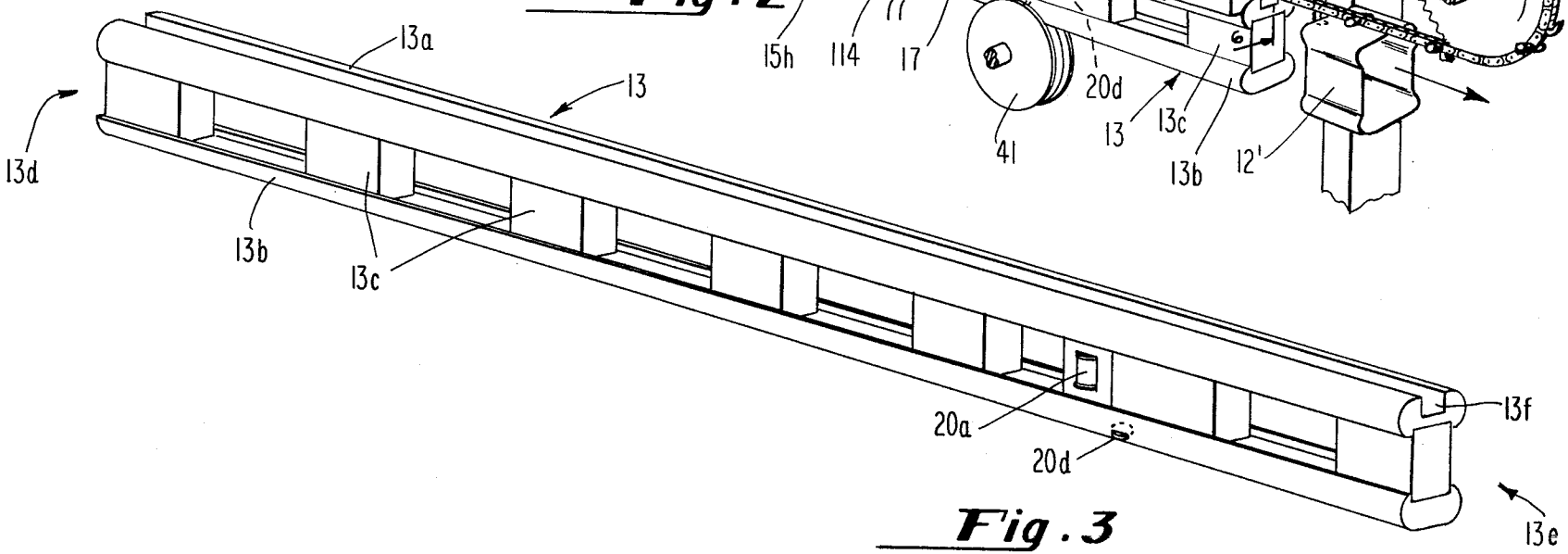
FIG. 3 is a perspective view of the reforming anvil.
Figure 4:
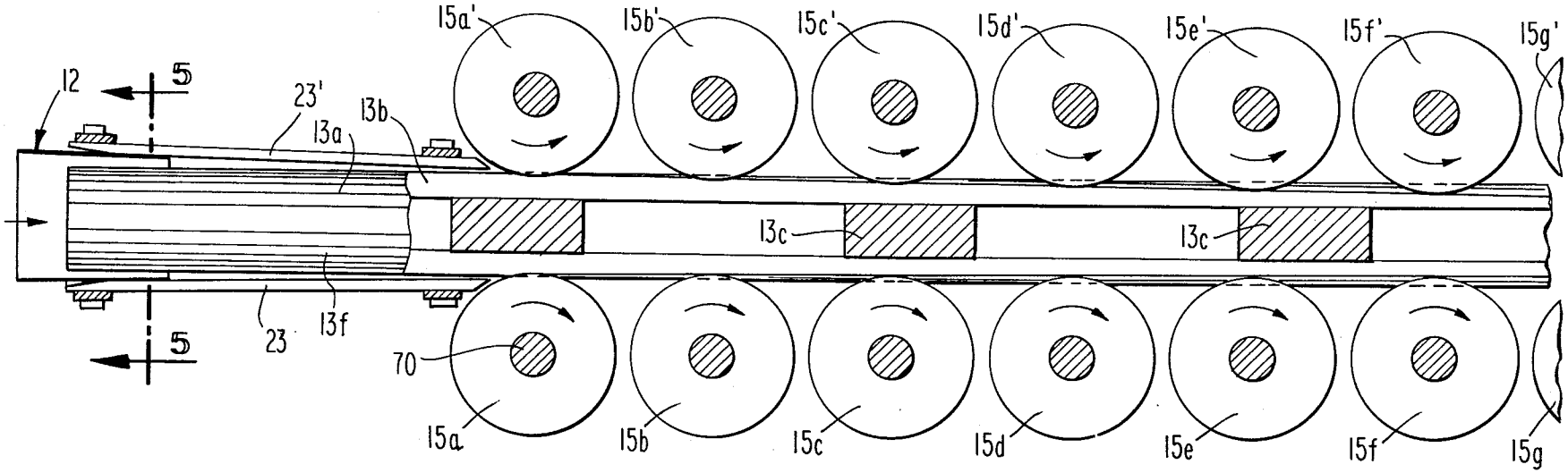
FIG. 4 is a cross section of the reforming apparatus taken along the lines 4—4 of FIG. 1.
Figure 6:
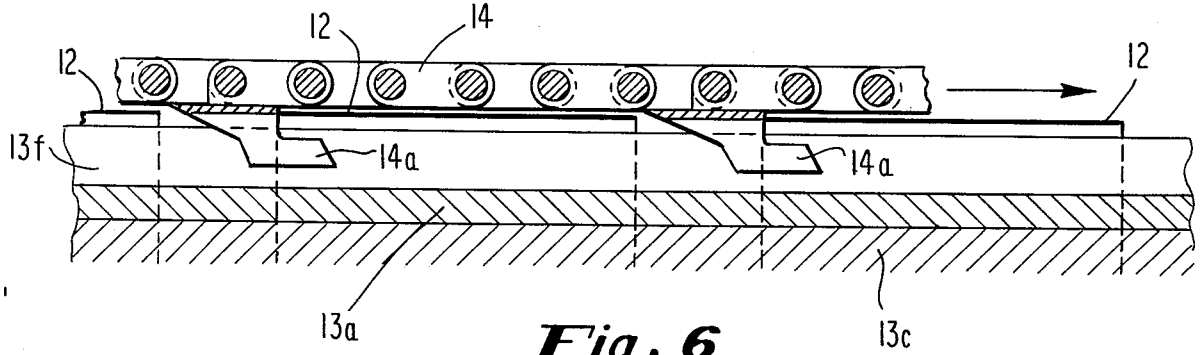
FIG. 6 is a partial section showing the gripper chain taken along the lines 6—6 of FIG. 2.

The chain 14 is arranged to convey cans 12 from the entrance end 13*d* of anvil 13 to the larger exit end, 13*e*, thereof. Thus, chain 14 has fingers 14*a* which engage the rearward end of the open-ended cans 12 as shown in FIG. 6. The chain is guided in a slot 22 of a frame member 19, and the fingers 14*a* of the chain 14 travel in slot 13*f* in the upper part, 13*a*, of anvil 13.

As the can passes from the entrance end 13*d* of anvil 13 to the exit end 13*e* thereof, the panelling rollers 15*a–h*, 15*a'–h'* gradually press the can 12 into a substantially rectangular shape. As the can 12 passes through the panelling rollers 114,114', the action of rollers 114,114' in conjunction with rollers 20*a*, 20*b* and smaller rollers 20*c* and 20*d* (FIG. 8) press the can 12 into a permanent rectangular shape, as shown by the can 12' in FIG. 2.

Figure 10:
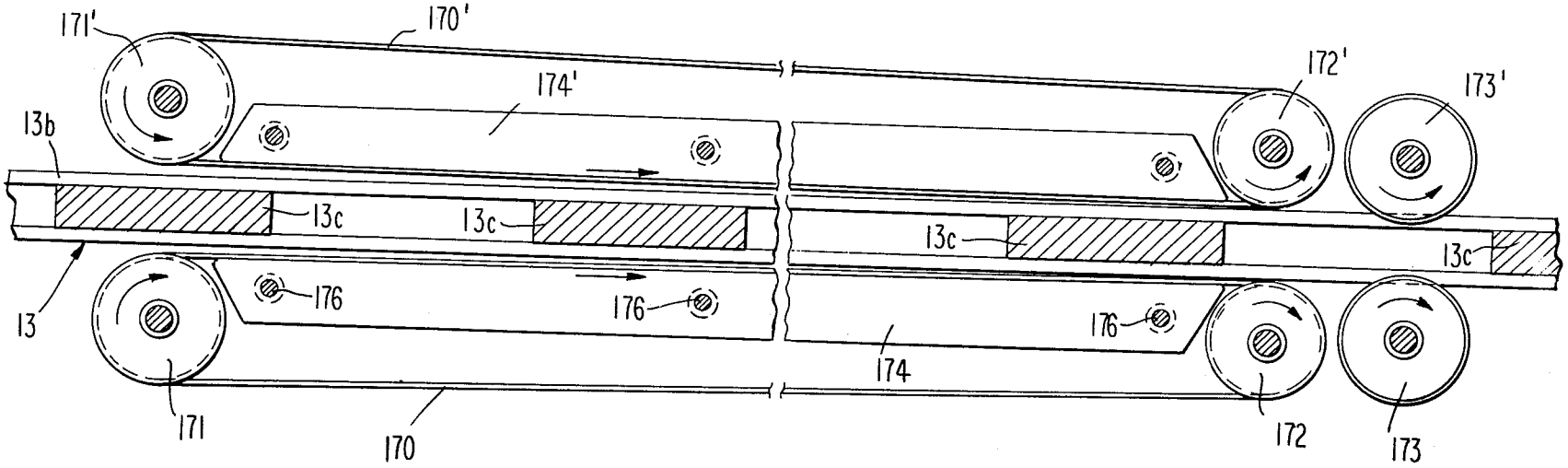
FIG. 10 is a cross section of the modified reforming apparatus of FIG. 9 taken along the line 10—10 of FIG. 9.
Figure 9:
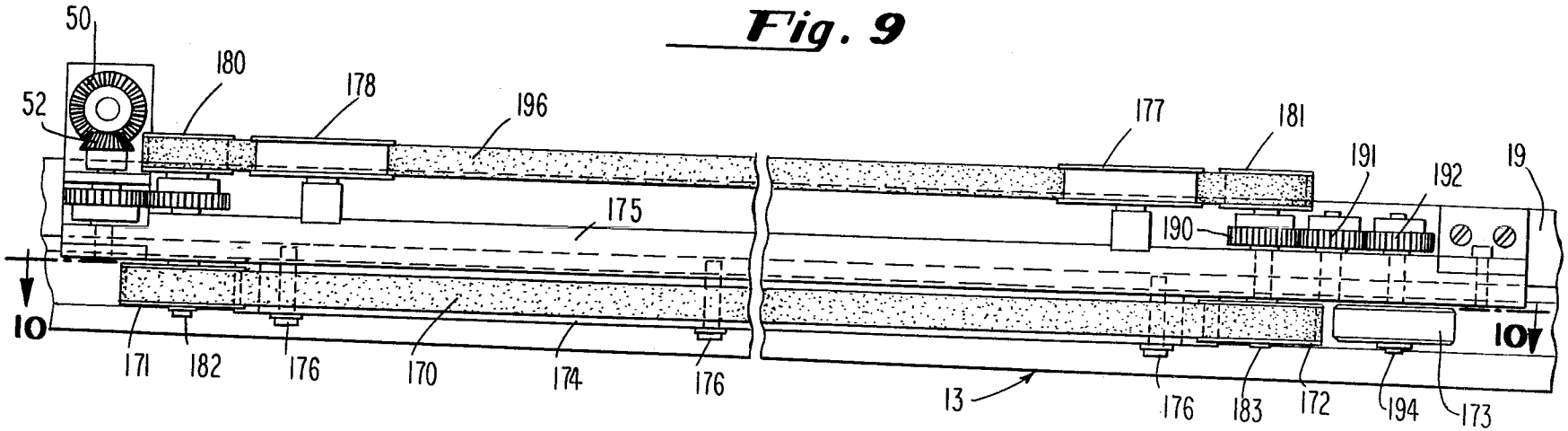
FIG. 9 is a side elevation of a modified reforming apparatus according to the invention.

In FIGS. 9 and 10 there is shown a modification of the apparatus which utilizes panelling belts 170,170' on either side of the anvil 13 instead of the rollers 15*a–h*. Belt 170 rotates around pulleys 171,172 and is supported to impose a pressing effect on the cans passing through the device by a support guide 174 which is fastened to a frame 75 by bolts 176.

Similarly, on the other side of the device, there is a panelling belt 170' passing around pulleys 171',172' and supported by guide 174'.

Near the exit end of the device there are a pair of opposed panelling rollers 173,173' which crease the can into rectangular shape. These rollers 173,173' are constructed the same as rollers 114,114' of the first embodiment and cooperate with an anvil 13 that is also constructed the same as anvil 13 of the first embodiment.

The means for driving belts 170,170' and rollers 173,173' is the same as in the first embodiment except that drive gears 50, 52 drives a drive belt 196 through suitable gearing. Belt 196 is kept under desired tension by tension pulleys 177,178 and rotates pulleys 180,181. In turn pulley 180 turns shaft 182 and the latter turns pulley 171 around which belt 170 passes.

Similarly, pulley 181 drives shaft 183 which turns pulley 172 about which belt 170 passes. Similar arrangements (not shown) drive belt 170'.

Paneling rollers 173,173' correspond to rollers 114,114' of the first embodiment. Roller 173 is driven by pulley 181 via gear 190 on shaft 183 which turns gears 191 and 192. The latter is affixed to shaft 194 of pulley 173. Roller 173' is driven by a similar arrangement (not shown).

By the means aforesaid, belts 170,170' and rollers 173,173' are driven at the same lineal speed as the can travels under control of the chain (not shown). The anvil is the same shape as anvil 13 of the first embodiment and cooperates with belts 170,170' and rollers 173,173' to reform cans from a round to a rectangular shape.

We claim:

1. Apparatus for re-shaping a round container into a rectilinear shape comprising:

a. a frame;

b. support means attached to the frame;

c. anvil means supported by said support means, said anvil extending from a container entrance end to a container exit end, said anvil being operable to receive a round container at said entrance end, said anvil means increasing in height from the entrance end to the exit end;

d. Means for conveying the container from the entrance to the exit end of the anvil means;

e. Forming means for displacing inwardly the round side of the container moved from the entrance end to the exit end of said anvil means, so as to form the round container into a generally rectilinear cross-section;

f. Paneling means to impart a permanent crease in the container along lines defining the edges of a rectilinear cross-section configuration.

2. The invention of claim 1, wherein the forming means comprises a spaced apart pair of support means, a series of forming rollers rotatably mounted on the support means, and means for driving the rollers at a peripheral speed equal to the speed at which the containter is conveyed along the anvil means.

3. The invention of claim 1, wherein the forming means comprises a spaced apart pair of support means, at least a pair of pulleys rotatably mounted on each support means, a belt around each pair of pulleys, and means for driving each belt at a peripheral speed equal to the speed at which the container is conveyed along the anvil means.

* * * * *